United States Patent [19]

Luggen

[11] Patent Number: 4,584,935

[45] Date of Patent: Apr. 29, 1986

[54] STOCK BALER

[76] Inventor: Leo J. Luggen, 5300 Hamilton Ave., Cincinnati, Ohio 45224

[21] Appl. No.: 647,130

[22] Filed: Sep. 4, 1984

[51] Int. Cl.[4] ..... B30B 9/30; B65B 13/04

[52] U.S. Cl. ..... 100/26; 100/3; 100/99; 100/232; 100/244; 100/245; 100/250; 100/255; 100/269 R; 100/278; 100/295

[58] Field of Search ..... 100/249, 250, 269 R, 100/279, 245, 295, 232, 26, 42, 244, 3, 264, 99, 278, 901, 255

[56] References Cited

U.S. PATENT DOCUMENTS

| | | | |
|---|---|---|---|
| Re. 28,748 | 3/1976 | Fredrickson . | |
| 677,148 | 6/1901 | Webb | 100/3 |
| 823,703 | 6/1906 | Sharp | 100/232 |
| 1,515,318 | 11/1924 | Tennebaum | 100/250 X |
| 3,003,296 | 10/1961 | Feldkamp | 100/26 X |
| 3,613,556 | 10/1971 | Wright et al. . | |
| 3,910,181 | 10/1975 | Andrews et al. . | |
| 3,942,429 | 3/1976 | Schmalz et al. . | |
| 4,002,115 | 1/1977 | Nanoia . | |
| 4,102,262 | 7/1978 | Liberman | 100/99 X |
| 4,182,236 | 1/1980 | Greer . | |
| 4,230,037 | 10/1980 | Schmalz | 100/232 X |
| 4,250,692 | 2/1981 | Uchida . | |
| 4,311,090 | 1/1982 | Dudziak et al. . | |
| 4,359,307 | 11/1982 | Johnson | 100/278 X |

FOREIGN PATENT DOCUMENTS

| | | | |
|---|---|---|---|
| 542120 | 1/1932 | Fed. Rep. of Germany | 100/232 |

*Primary Examiner*—Billy J. Wilhite
*Attorney, Agent, or Firm*—Frost & Jacobs

[57] ABSTRACT

A stock baler comprising a container having a bottom floor, two side walls, a stationary end wall and a movable end wall and a pair of side rams positioned in the side wall adjacent to the stationary end wall. Both the movable end wall and the pair of side rams include means to advance and retract one another respectively. The stationary end wall and the movable end wall have mating V-shaped grooves in which the open portion of the groove mates with the open end of the other groove, and the apex of each V-shaped groove is positioned on substantially the same horizontal plane. The pair of side rams are shaped to advance and retract within the mating V-shaped grooves.

16 Claims, 12 Drawing Figures

STOCK BALER

BACKGROUND OF THE INVENTION

1. Field of the Invention

The present invention relates to stock balers for fibre waste bagasse, solid waste, and in particular, to paper balers which include binding apparatus for baling and binding paper.

2. Prior Art

Generally, the first stock baler was the chain drive downstroke type. This baler consisted of a steel box frame with a door on one side. The ram or platen was attached to a chain, and when fully retracted, the platen uncovered the top of the baler leaving the baler open. The stock was fed through the top and when filled, the compression cycle started with the chain transporting the platen over and through the top opening of the steel box, thus closing the steel box. The chain continued pulling the platen downwardly thus compressing the stock. When the amperage on the motor rose to a preset point, the motor would be stopped and the spring loaded brake would hold the stock under compression. The side door would then be opened and the bale tie wires would be placed around the bales to hold them in a compressed condition. After binding the bales of stock, the platen would be raised and retracted to release the tied bale through the side door of the steel box.

A second type of stock baler was the upstroke type in which the platen or ram was chain driven or driven by a hydraulic piston. This baler had a top section similar to the down stroke type baler, but had doors on both sides, rather than just one side. The bottom of the baler extended below ground into a pit. The platen was lowered into the bottom part of the baler below ground and the baler was charged with stock by opening the side door and dumping stock into the below-ground portion of the baler. When filled, the side door was closed and the baler was activated causing the platen to rise and compress the stock against the top of the steel box frame, which was above ground. As the compression rose, the motor amperage would rise and a current relay would trip the power to the motor. A spring loaded brake would hold the stock under compression. One of the side doors would open and the bale would be bound with wire or the like. The platen would be partially lowered to release the bale from compression to permit the bale to be extracted from the baler. Then, the platen would be lowered to the bottom of the baler to repeat the entire process.

The next advancement in baler devices was the horizontal baler. This baler consisted of a steel fabricated rectangular tube with a ram or platen powered by a hydraulic cylinder. Stock would drop through a chute in the top of the tube by gravity. The ram would move toward the stock and shear off excess stock above the chute opening and compress the stock against the previous charge of compressed stock in the rectangular tube. There were two types of horizontal balers and each restricted the baled stock in the rectangular tube in a different manner.

The first type was the closed door horizontal baler. This baler had a steel door at one end of the tube to provide resistance for the ram to compress the rectangular stock. When sufficient stock charges were compressed to form a bale, the ram would stop in the compressed position and bale tie wires would be installed. Then the door was opened and the ram retracted to pick up the next charge. The ram would continue to cycle and compress the stock against the weight of the tied bale until it was discharged from the end of the tube. When the bale fell free, the steel door would be closed and the ram would again be compressing stock charges against the steel door until sufficient stock charges formed a bale.

The second type was an open end horizontal baler (extrusion type). The open end baler included an extended rectangular tube which permits the use of hinged sides so pressure may be applied to constrict the opening to build resistance against the stock being forced through the tube. When the compressed charges reached the proper length, the ram stopped in the forward position. A rubber block was then dropped into the baler to separate the stock into the baled lengths, so that they could be tied while additional charges were being made. Thus, production would not be delayed during the tying operation. This block drop method was discontinued when automatic tying was introduced.

The horizontal balers were successful but presented several problems. The ram had to shear off excessive stock at the feed chute. And when laminated stock was employed, the ram occasionally stalled, shear bar supports periodically bent, and a rooster tail sometimes formed on the finished bale. Moreover, the closed door baler permitted stock grade changes easily, while the open end horizontal baler depended on the surface of the stock for resistance in obtaining uniform bale density. However, when high resistant stock was followed by smooth low resistant stock, a light, loose density bale resulted. Also, both types of horizontal balers employed shredders to reduce the size of the stock to permit passage or conveyance of the stock through the feed chute. The increase in horsepower of the shredder, maintenance of the shredder, and the dust, causing a potential fire hazard, were often additional problems associated with horizontal balers.

To eliminate the shredding operation and to permit the use of large stock (sheets, cartons, boxes), which was incapable of fitting through the feed chute, the Harris and Logemann balers were developed. This baler had a steel box with a hydraulic powered platen or ram positioned at one end of the steel box. One end of the steel box was covered and a shear knife was mounted adjacent the leading edge of the cover. Stock was fed into the steel box through the partially open top. The shear knife cut off protruding stock as the platen advanced the stock toward the closed end to compress the stock. When sufficient paper was compressed under the covered end of the baler, the platen remained in the compressed postition to maintain the stock under compression in a bale.

The stock bale was ejected from the baler by a second hydraulic platen which shoved the bale through a side door. As the stock emerged, the ejection platen would momentarily stop and an automatic tying mechanism would secure the compressed bale.

This device had several disadvantages, namely, the charged stock was generally centered in the baler which produced loosely packed ends; if the operator overcharged the baler, the baled stock would not fit through the side door; and the shear knife was incapable of consistently shearing laminated stock and sometimes the shear knife bent or broke.

To cure the above problems, the next advancement in balers was the N.S.B. American. This baler contained a feed opening in the side of a rectangular tube.

This was achieved by having two intersecting rectangular tubes in which the second rectangular tube included a feed opening in its top surface into which the feedstock was charged. When sufficient stock substantially filled the second rectangular tube, a side ram would shove the stock into the main compression rectangular tube through the above-mentioned side opening. The side ram would remain at this position while the primary compression platen moved forward to compress the stock into a bale. Thus, the side ram served as a side wall for the main compression rectangular tube of the baler.

The no shred baler had a shear point on the feed opening when the side ram shoved stock into the main compression rectangular tube. Moreover, this baler necessitated time-consuming digging out when overcharging the baler occurred.

Consequently, there exists a need for a baler having a large feed opening to eliminate the need for shredding; permit charges in grades of stock without a lengthy adjustment period, predetermine bale weight and stock to eliminate undercharging, overcharging and decrease the need for a skilled operator; and produce uniform density bales to eliminate loose ends.

SUMMARY OF THE INVENTION

The present invention eliminates the shortcomings of the horizontal baler and in particular eliminates the shear point or shear edge of a horizontal baler because the top wall of the baler of the present invention has been completely eliminated. Moreover, a more uniform density bale is produced by the apparatus of the present invention because three different rams or platens compress the paper. The device of the present invention also includes automatic binding apparatus which may be, for example, incorporated into the contact surface of the rams or platens.

To prevent overcharging or undercharging the predetermined bale weight, and to make grade changes in paper easier, the present invention includes load cells upon which the baler is mounted. If the type of paper being baled changes grade appreciably, or moisture absorbed by the paper varies appreciably, the load cells can be reprogrammed to indicate when the correct amount of paper has been supplied to the baler.

Typically, the baler would be fed by a conveyor where an operator programs the load cell control depending upon the particular grade of paper on the conveyor. When the weight of the paper reaches the desired setting, the conveyor automatically stops feeding paper into the baler. A large movable platen proceeds forward to mate with a corresponding wall forming a rectangular tube approximately three foot, by three foot, by ten foot. When the platen is in place and has formed the rectangular tube of paper, it locks securely into position and a pair of side rams move forward to compress the paper stock. Once the side rams have achieved the desired compression, automatic tie wires are bound around the bale and tied into place. The side rams are partially retracted when a door in the corresponding mating wall of the platen is lifted upwardly so that the bale may be removed form the hopper. Simultaneously, the platen and side rams are retracted to their original positions.

In the broadest sense, the present invention comprises an open-faced baler having a first platen which mates with a corresponding wall of the baler to form a rectangular tube; and a pair of side rams, one ram on each side of the rectangular tube to further compress the paper when the first platen mates with the corresponding wall. Additionally, the broadest sense of the present invention may include forming the platen to have a V-shaped cutout, which correspondingly mates with the end wall of the baler also having a V-shaped cutout, so that the mating of the platen and the corresponding end wall of the baler produces a rectangular tube.

DESCRIPTION OF THE PREFERRED EMBODIMENTS

Figure 1:
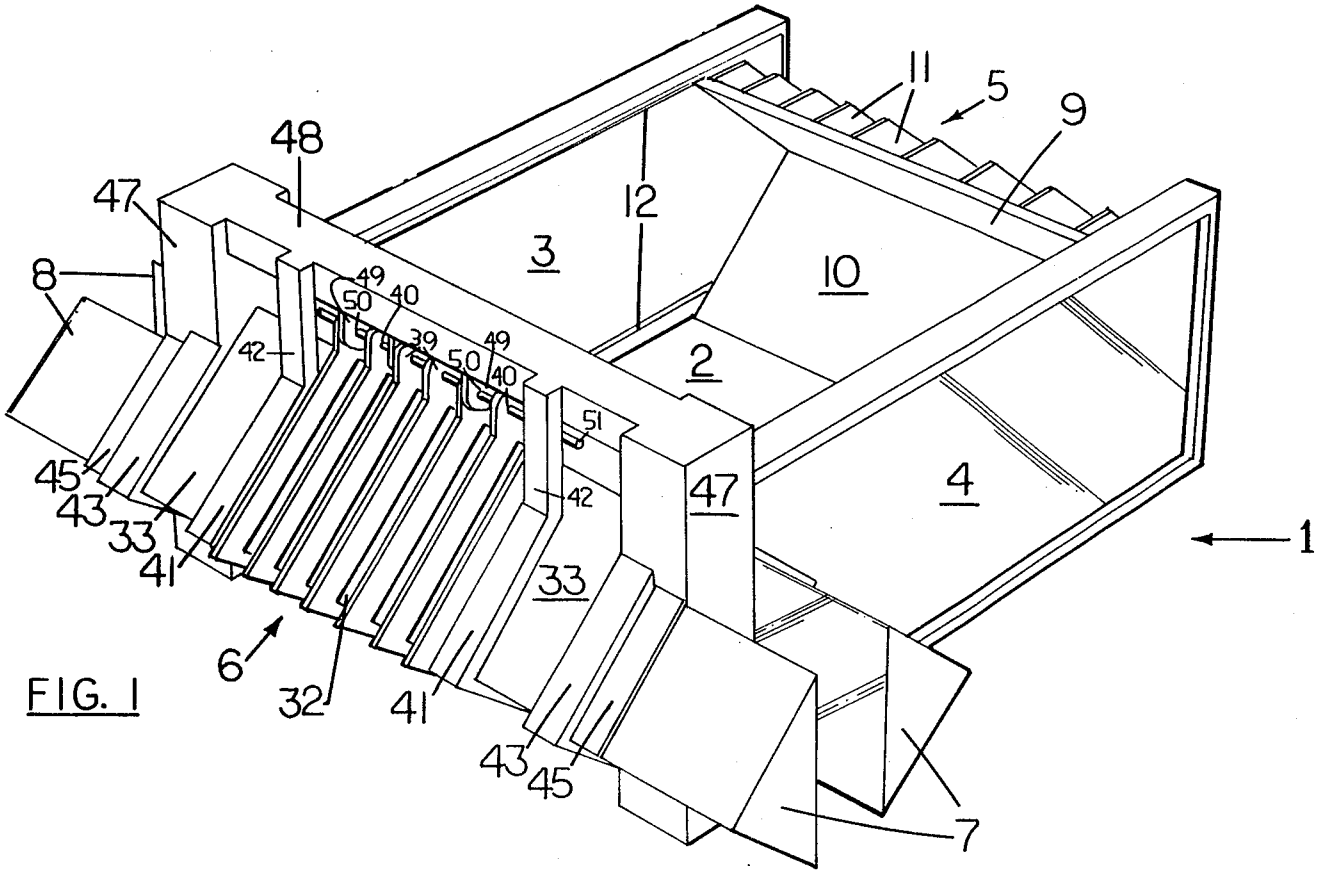
FIG. 1 shows an elevational perspective view of the device of the present invention in its fully opened position.

As shown in FIG. 1, the baler of the present invention, which is generally indicated by reference numeral 1, broadly comprises a flat planer floor 2, side walls 3 and 4 which are perpendicularly attached to the floor, and end walls 5 and 6. End wall 5 is actually a movable platen, while end wall 6 is held stationary, but includes a door 32 which may be swung open as will be later described. Side rams 7 and 8 are mounted at one end of walls 3 and 4 adjacent end wall 6.

Floor 2 is generally a flat planer metal plate. Although materials other than metal may be employed, the strength and durability of metal makes it an ideal material not only for the floor but for the side walls, platen and rams. Typically, the material employed must be able to withstand forces developed by the platen on the floor and side wall surfaces of several thousand p.s.i.

As stated previously, end wall 5 comprises a movable plate which traverses the length of the stock baler until it is positioned adjacent end wall 6. The particular prime mover employed to move the end wall or platen 5, toward end wall 6 may be a hydraulic cylinder system or a chain driven motor system, or the like.

Platen 5 comprises a flat upper portion 9, such as sheet steel, which is attached to or integrally formed with a flat lower portion 10, which is made of the same material a upper portion 9. Upper portion 9 and lower portion 10 are approximately positioned at a 90° angle to one another. Additionally, upper portion 9 is oriented at about a 45° angle to the bottom surface 2. The lower portion 10 is also mounted at about a 45° angle to the bottom surface 2 so that when the upper and lower portions 9 and 10 are properly oriented within the baler, they form a V-shaped groove with the apex of the V-shaped groove projecting toward the outside of the baler, while the open portion of the V-shaped groove projects toward the inside volume of the baler. In order to further strengthen the platen 5, angle members 11 are mounted on the outside surface of the upper portion 9 and lower portion 10. The angle members 11 are thin platelike members which are mounted perpendicular to the outer surface of both the upper portion 9 and the lower portion 10 so that they project outwardly from the outer surfaces of each portion.

Figure 3:
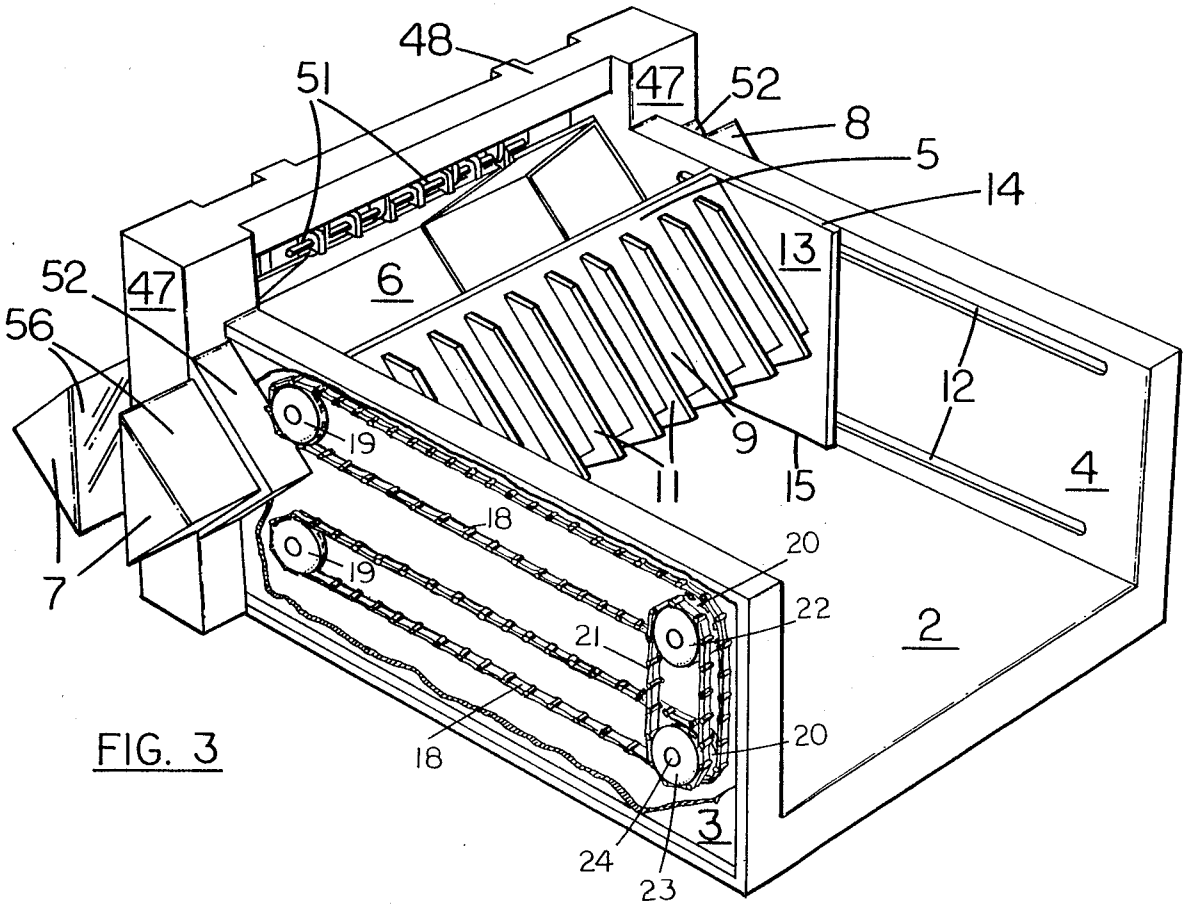
FIG. 3 shows a fragmentary perspective view of the device of the present invention in which the primary platen is approaching its mating end wall.

It is preferable that the platen 5 traverse the baler by guide means so that the platen will not twist and jam within the baler while it traverses the length of the baler. For example, grooves or rails could be mounted on the bottom surface of the baler or they could be provided on side walls 3 and 4 of the baler as is shown in FIG. 1 and depicted by reference numeral 12. Although FIG. 1 shows a groove 12 mounted atop the inside surface of the side wall 3, the grooves or rails could be mounted anywhere on the side wall, or even a plurality of grooves or rails could be mounted on each side wall. Likewise, the bottom surface could include a plurality of rails. The type of guide means must be durable, and sufficiently strong to withstand the pressure developed and yet create minimum friction to the transverse movement of the platen sides. Guide means having a coating of low friction material, such as Teflon, are preferred because the platen is less likely to twist and become jammed during the traversal toward end wall 6. When guide means 12 are employed, the platen must be equipped with a corresponding mating portion designed to slide in, on or over the guide means depending upon the type of guide means employed. For example, platen 5, as shown in FIG. 3, includes a pair of platen end plates 13 (only one is illustrated) having a V-shaped groove so that it attaches to both upper portion 9 and lower portion 10 of the platen in substantially the same manner as the angle members 11. The platen end plates 13, which are parallel to the angle members 11, project beyond the outer surfaces of the upper portion 9 and lower portion 10 a distance substantially past that of the angle members. Additionally, the platen end plates 13 each include a horizontal upper surface 14 designed to mate with one of the walls 3 or 4, and a horizontal lower surface 15 designed to slide along the floor 2 of the baler. Thus, the platen end plate 13 prevents the platen 5 from rising upwardly due to the guide means 12, and they prevent the platen 5 from attempting to buckle downwardly due to the horizontal lower surface 15 mating with the floor of the baler.

Figure 11:
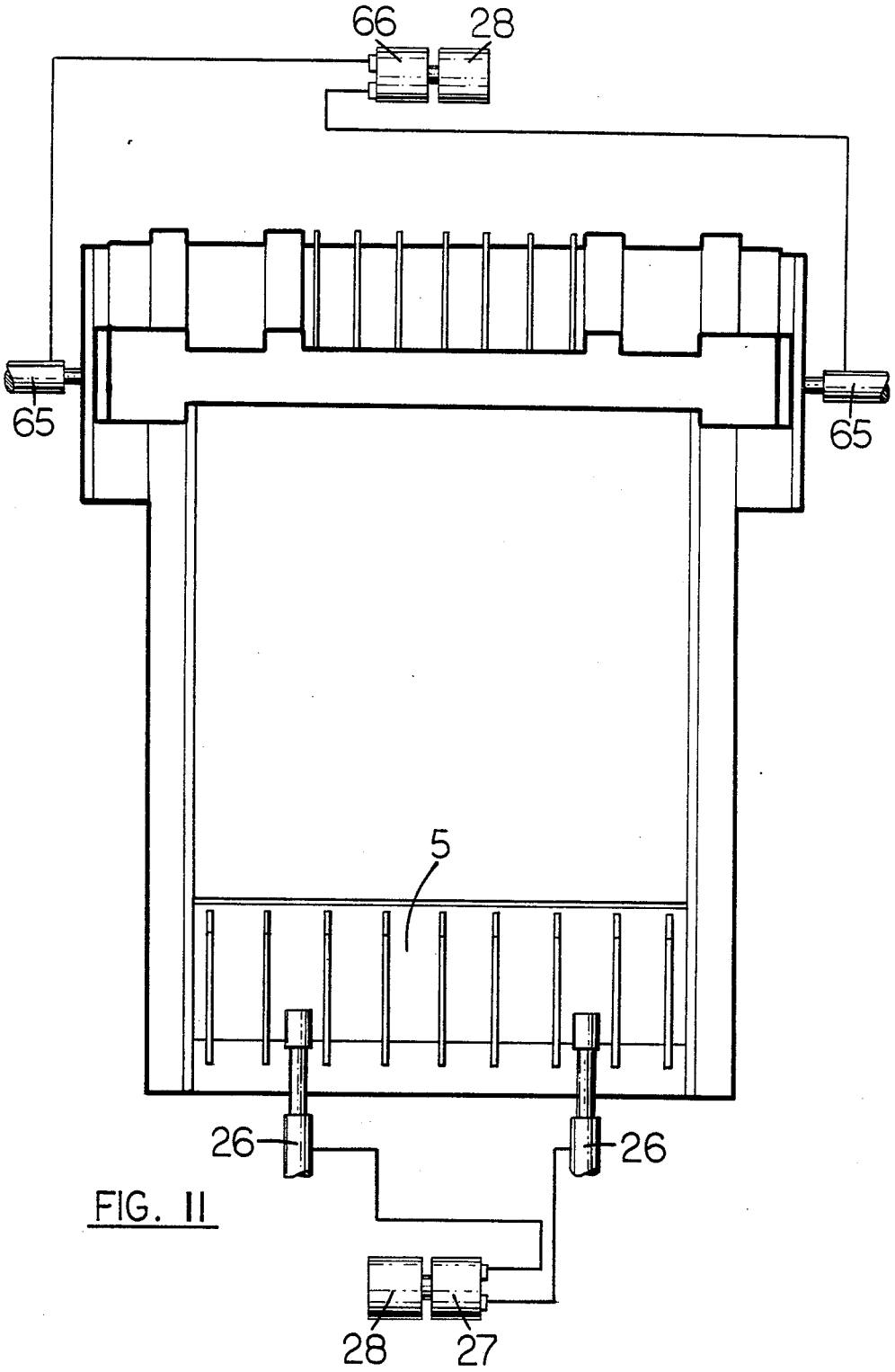
FIG. 11 is a diagrammatical view of the optional hydraulic system of the present invention.

As previously stated, the particular type of prime mover to drive the platen 5 toward the end wall 6 may be any type so long as sufficient power is developed so that the platen may sufficiently compress the stock. If hydraulic cylinders are employed to move the platen across the baler, as illustrated in FIG. 11, it would be preferable to employ a single hydraulic cylinder in order to provide uniform pressure upon the platen. However, this may not be practical from the standpoint of developing sufficient power to adequately compress the stock, and the economics of one huge cylinder may be more expensive than that of a pair of smaller cylinders, for example. On the other hand, if a pair of small cylinders are employed, it is difficult to achieve a uniform pressure from each hydraulic cylinder in order to uniformly advance the platen toward end wall 6 and to provide an end product which is compressed to the same degree such that the density is uniform. If a single hydraulic cylinder were employed, it would of necessity be employed approximately at the mid-point of the platen in order to provide uniform force across the surface of the platen. If a pair of hydraulic cylinders are employed, they could be mounted on the outside of side walls 3 and 4 and be directly coupled to the platen through a longitudinal slit in each side wall, or they could be mounted behind the platen, as illustrated in FIG. 11.

Figure 9:
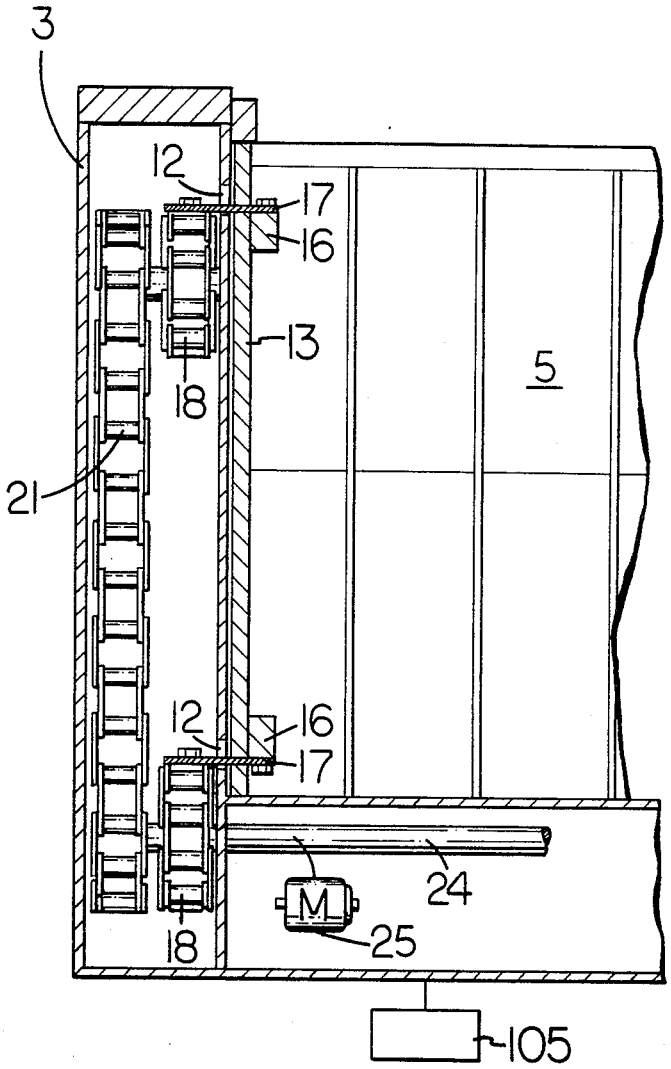
FIG. 9 is a fragmentary cross-sectional view of the side wall of the baler illustrating the chain drive mechanism.
Figure 10:
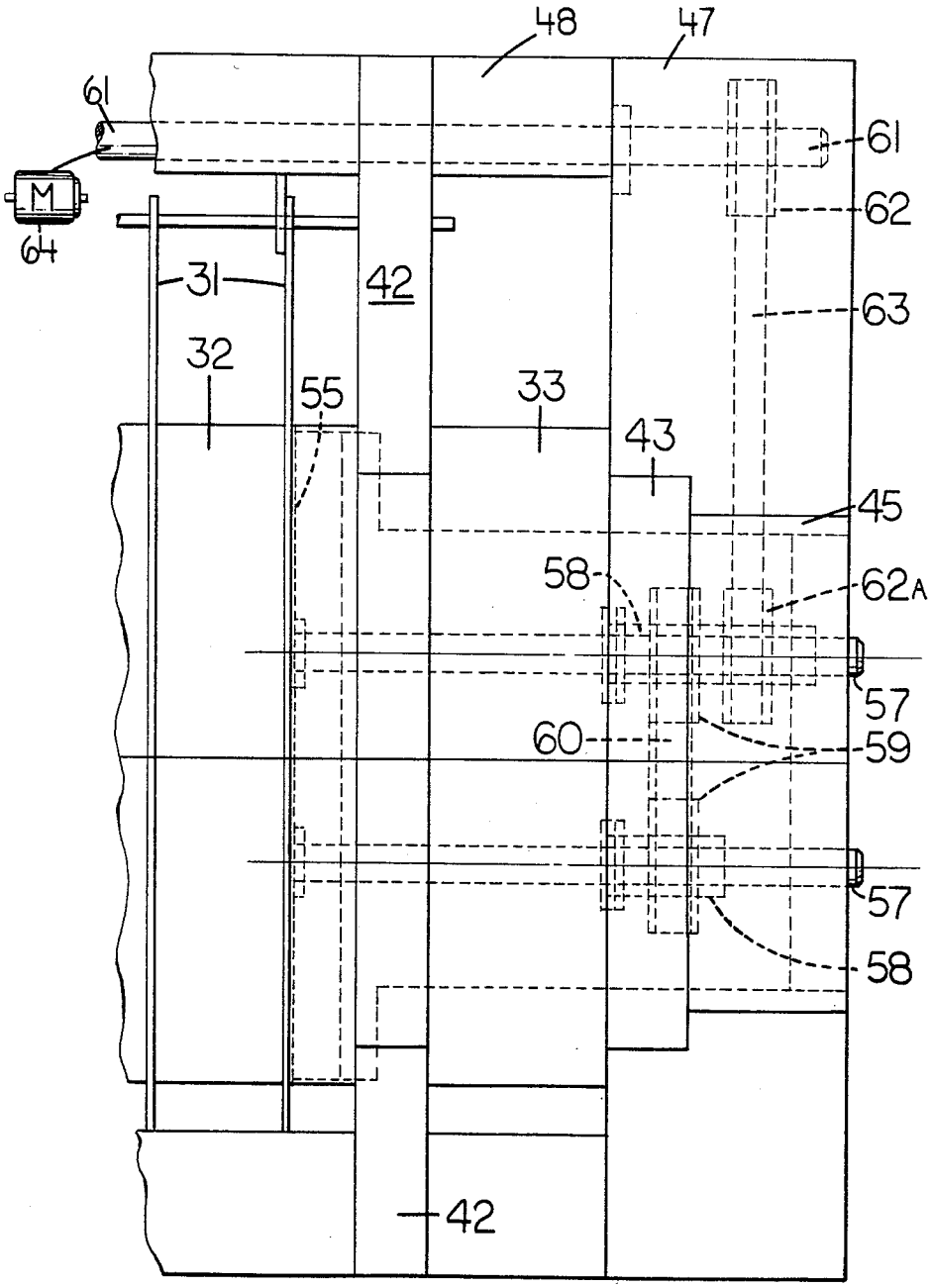
FIG. 10 is a fragmentary end view of the baler illustrating one of the chain drive's side rams of the present invention.

If a chain drive and motor are employed to advance the platen toward the end wall 6, the chain may be mounted within side walls 3 and 4. The particular type of motor may be electric, gas or pneumatic, but preferably the motor is a hydraulic motor. By way of example only, the chain drive system is shown in FIGS. 3, 9 and 10.

In order to drive the platen 5 by a chain drive system, the platen must have means to attach to the chain system. For example, platen 5 can be provided with one or more attachment blocks 16, which are level with the grooves 12. One or more projections 17, which extend outwardly from platen end plates 13 into grooves 12, are attached to the chains 18 by welding or the like. Projections 17 serve as guide means to prevent the platen 5 from twisting or moving in any direction other than toward and away from end wall 6. As shown in FIGS. 3 and 9, there are two chains 18 corresponding with each groove 12. The longitudinal grooves 12 line up with the upper segment of chain 18. Each chain 18 is carried by a pair of sprockets 19 and 20 which are mounted adjacent to the ends of the longitudinal grooves 12.

In order to assure synchronization of the chains 18 on a side wall, a vertically looped chain 21 is carried by sprockets 22 and 23. The pair of sprockets 20 share a common shaft with sprockets 22 and 23 so that rotation of either chain 18 causes rotation of chain 21, and vice versa. Accordingly, rotation of chain 21 causes both the upper and lower chains 18 to advance an equal distance over the same period of time, in part because all the sprockets 19, 20, 22 and 23 are the same size. In this manner, the advancement of the platen 5 by means of upper and lower chains 18 is maintained constant for the side wall 3, for example. Because side wall 4 has the same arrangement, the upper and lower chains 18 mounted on side wall 4 assure that platen 5 adjacent to side wall 4 also advances uniformly. In order to assure that the chain driven system mounted on side wall 3 is driven at the same uniform rate as the chain driven system mounted on side wall 4, a common shaft 24, as shown in FIGS. 3 and 9, rotates sprockets 20 and 23. Consequently, rotation of shaft 24 by a prime mover 25, such as an electric motor, hydraulic motor, pneumatic motor, or the like, causes sprockets 19, 20, 22 and 23 on both side walls 3 and 4 to rotate at a uniform rate. This rotation in turn assures that both the upper and lower chains 18 on both sides 3 and 4 advance the platen in a uniform manner toward end wall 6.

As illustrated in FIG. 11, a pair of hydraulic cylinders 26 are employed. The pair of hydraulic cylinders 26 are attached at one end to the platen 5, while the other end is attached to a foundation portion adjacent the paper baler. Optionally, the other end of the hydraulic cylinders may be secured to the floor 2 on the outside of platen 5. In order to assure a uniform advancement of platen 5 toward mating end wall 6, a control mechanism 27 and hydraulic fluid pump 28 are employed. Control mechanism 27 assures that each cylinder 26 is under the same hydraulic force and assures that the cylinders 26 advance the platen 5 equally. As discussed previously, the pair of hydraulic cylinders may be replaced by a single cylinder not shown. If a single cylinder is employed, the control mechanism 27 may be eliminated so that the single cylinder receives hydraulic fluid directly from the pump 28.

Figure 4:
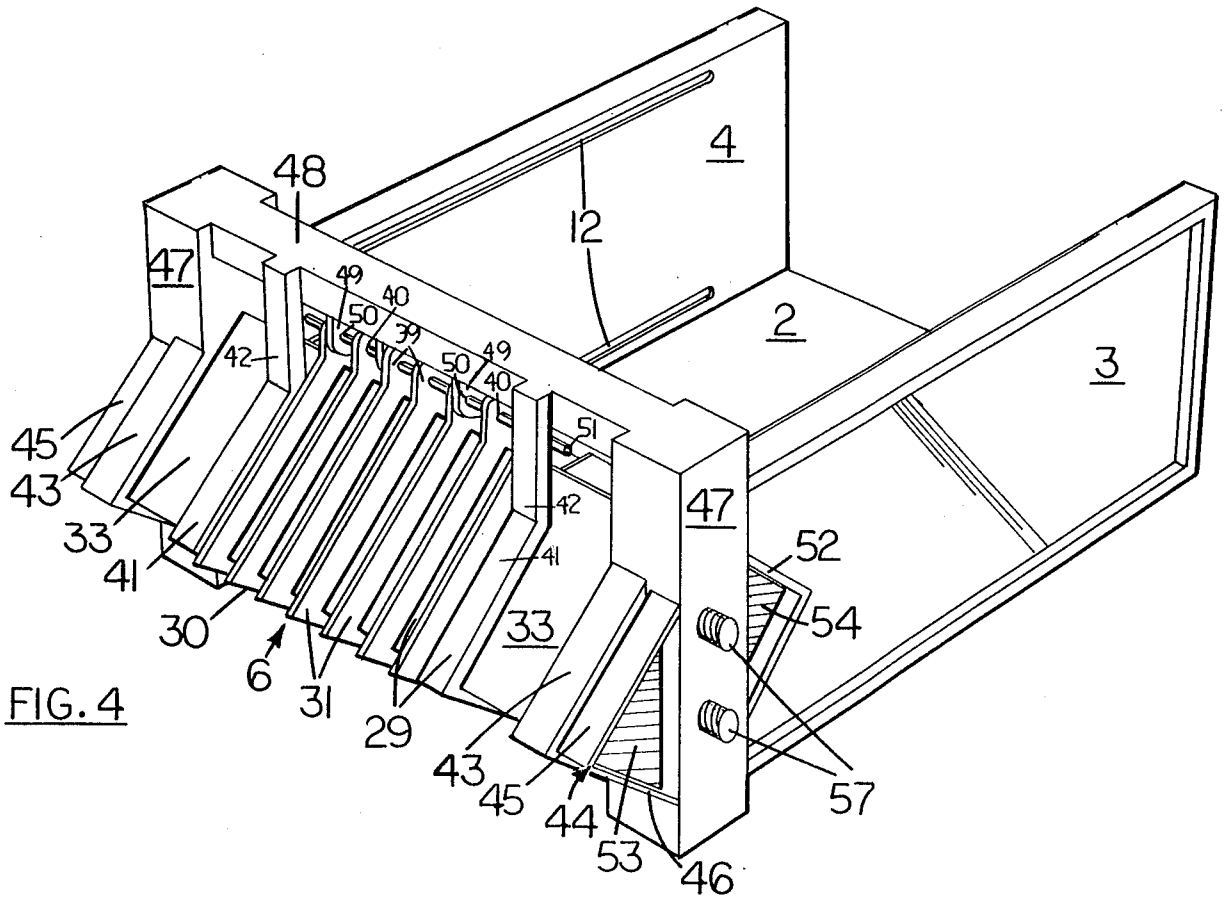
FIG. 4 illustrates an elevational perspective view of the device of the present invention in which the baler is in its fully compressed position.
Figure 5:
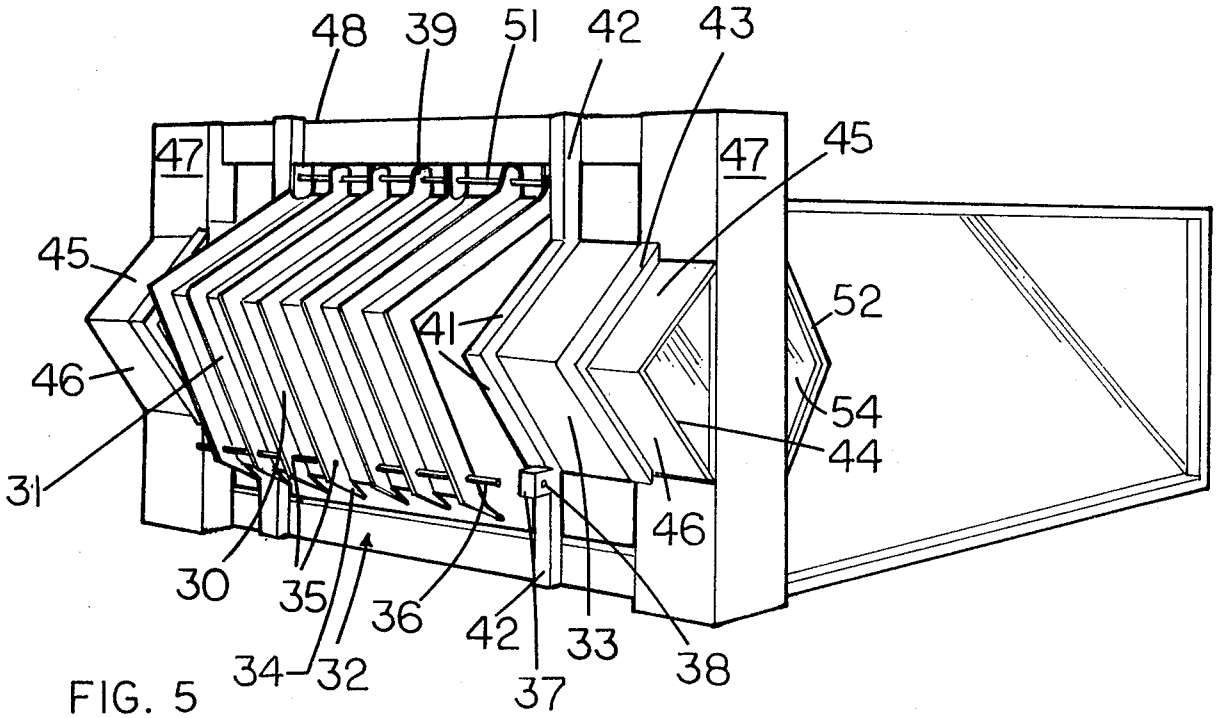
FIG. 5 illustrates the device of the present invention in which the mating end wall has been opened to discharge the compressed and bound bale of paper.

End wall 6, more fully illustrated in FIGS. 4 and 5, includes a flat upper portion 29 and a flat lower portion 30. Like the flat upper portion 9 and flat lower portion 10 of the end wall platen 5, the flat upper portion 29 and the flat lower portion 30 are integrally attached at a right angle. The flat upper and lower portions 29 and 30 are positioned such that the lower portion 30 is at a 45° angle from bottom surface 2 and directed outwardly, while the upper flat portion 29 is also at a 45° angle with respect to bottom surface 2 but is directed inwardly, so that their apex projects away from the interior of the baler 1. Additionally, the end wall 6 has angle members 31 similar to angle members 11 of the end wall platen 5. Angle members 31 include two legs of approximately equal distance which are substantially perpendicular to one another. The angle members 31 are positioned on the outside surface of the flat upper portion 29 and the flat lower portion 30 such that they are perpendicular to these portions and project away from each portion.

End wall 6 comprises a centrally located door portion 32 and two stationary end members 33 positioned on each side thereto. As illustrated in FIG. 5, the angle members 31 are positioned only on the door 32. The lower portion of each angle member 31 is provided with a curved inwardly tapered portion 34 designed to fit beneath bottom surface 2 in order to provide support for the bottom surface in the area adjacent door 32. Of course, the curved inwardly portion 34 of each angle members 31 may be eliminated, if desired.

At the lower end of each angle member 31 adjacent to the junction of the angle member and the curved inwardly tapered portion 34 is a hole 35. The holes 35 in each of the angle members are designed to carry a pair of locking members 36 which are nothing more than iron rods which slide in the holes 35, and correspondingly slide into holes 38 of a pair of latches 37, only one of which is shown in FIG. 5. The latches 37 are mounted upon arms 42 of each stationary end member 33.

The upper portions of each angle members 31 include a rounded extension 39, which projects beyond the upper edge of the end wall 6 as best seen in FIGS. 1 and 4. Each extension 39 contains an aperture 40. These apertures are aligned to accept a hinge pin as will be more fully described below.

As shown in FIG. 5, stationary end members 33 have additional chevron bracing 41 including a pair of vertical arms 42 positioned at the upper and lower ends of the chevron bracing 41. The chevron bracing 41 is oriented in the same manner as angle members 31, including the fact that its apex projects outwardly away from the baler. If the baler is mounted upon a stationary support such as a concrete floor, then the lower vertical arm 42 of each chevron bracing 41 may be employed to anchor the baler by extending the lower vertical arm 42 into the support. Additionally, V-shaped bracing 43, oriented as chevron bracing 41, may be employed for added support.

Each stationary end member 33 has a smaller extension wall 44 which projects beyond the edge of the end wall 6. The extension wall 44 includes a flat upper portion 45 and the flat lower portion 46.

Mounted upon the side walls 3 and 4 of baler 1 are substantially hollow upright support members 47 which extend significantly above the upper edge of the side walls 3 and 4, and above the rounded extension portion 39 fo the angle members 31, so that the hollow upright support members 47 become the highest part of the baler. Extension wall 44 is smaller than stationary end members 33 because the flat upper portion 45 terminates as does the flat lower portion 46 at an end wall of hollow upright support members 47 as illustrated in FIGS. 1 and 5.

Attached to the upper end of each of the hollow upright support members 47 is a beam 48 which extends between the upright support members 47 and is additionally supported by the upper vertical arms 42 of the chevron bracing 41. Integrally attached to the bottom surface of beam 48 are a plurality of hinge plates 49 which project downwardly from beam 48 in a perpendicular fashion. Hinge plates 49 are attached to beam 48 so that they are positioned adjacent the rounded extensions 39 of angle members 31, and significantly vertically overlap one another. Each of the hinge plates 49 contains an aperture 50 of the same size as aperture 40 in rounded extensions 39. Apertures 40 and 50 are in alignment with one another so that one or more hinge pins 51 may be employed to pivot door 32 around the hinge pin 51 so that the door swings open from the bottom and is carried by beam 48 as it pivots around the hinge pin. Optionally, a means to open the door such as a hydraulic cylinder or a motor with chain may be employed, as is conventionally known in the art. For example, a small motor could be mounted on the side of beam 48 and a cable or chain could extend and fasten to the apex area of the angle members 31 so that the motor, when retracting the cable or chain, will lift door 32 upwardly to permit the bounded bale to be ejected from the baler.

Side walls 3 and 4 each contain a V-shaped member 52 adjacent the end of the side wall which mates with end wall 6. The V-shaped member 52 is oriented such that its open end faces end wall 6 while its apex is directed toward end wall platen 5, when the end wall platen 5 is in its normal fully opened position.

The cross-sectional areas 53 formed by the hollow upright members 47 and extension walls 44, as illustrated in FIGS. 4 and 5, is substantially the same as cross-sectional areas 54 formed by the V-shaped members 52 and the hollow upright support members 47. The apex of both the cross-sectional areas 53 and the cross-setional areas 54 lie within the same horizontal plane so that not only are the cross-sectional areas substantially equal in size, but they are aligned with one another on each side of the hollow upright support members 47.

Figure 2:
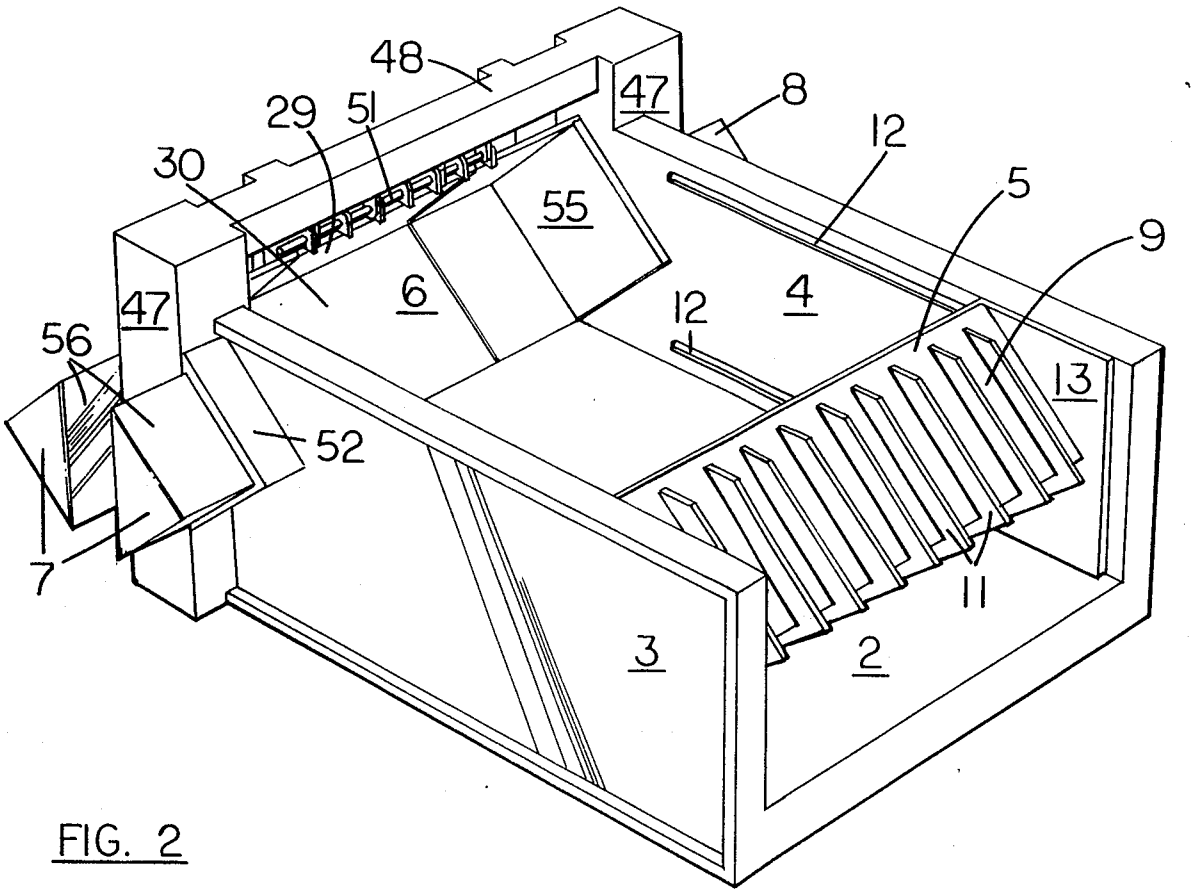
FIG. 2 shows another perspective view of the opposite end of the device of the present invention in the fully opened position.

Side rams 7 and 8 are substantially identical to one another and thus only one ram need be described. The side ram 7 or 8 contains a square compression plate 55, as shown in FIG. 2, which is oriented to fit within the enclosure formed when end wall platen 5 mates with end wall 6. Accordingly, square compression plate 55 is oriented on one of its corners on bottom surface 2, while the diagonally opposite corner projects upwardly and extends until it is adjacent the upper edge of flat upper portion 29 of end wall 6. The two remaining corners of the square compression plate 55 are oriented in the same horizontal plane, which corresponds with the aligned apexes of end wall platen 5 and end wall 6, which is also in alignment with the apexes of the cross-sectional areas 53 and 54.

Attached to each square compression plate 55 are two integrally formed triangular guides 56 as illustrated in FIGS. 2 and 3. The upper edge of each triangular guide 56 does not extend upwardly the same distance as the upper portion of each square compression plate 55. The triangular guides 56 are mounted on each side of the square compression plate 55 and have an apex which is in alignment with the corners of the square compression plate 55 that are in the same horizontal plane with one another. The triangular guides 56 extend outwardly from the side of the square compression plate 55 such that they are perpendicular to side walls 3 and 4. The pair of triangular guides 56 on each square compression plate 55 are of a length such that when the rams 7 and 8 are in their fully closed position, the triangular guides 56 still extend into cross-sectional areas 53 and 54. This arrangement ensures that the square compression plates 55 will always be properly oriented when moving from the fully opened position to the fully closed position, and vice versa, because the triangular guides 56 will always be bound by the cross-setional areas 53 and 54.

Side rams 7 and 8, like end wall platen 5 can be moved by a prime mover, such as a hydraulic cylinder system, or a chain drive and motor driven prime mover, in much the same manner as end wall platen 5.

If a chain driven system is employed, as is illustrated in FIG. 10, a pair of horizontally mounted vertically superimposed shafts 57 with screw threads journaled thereon are mounted to the square compression plate or optionally to the triangular guides 56. Shafts 57 extend through the hollow upright support members 47 (see FIG. 4) and project outwardly therefrom.

Securely fastened to the hollow upright support members 47 are a pair of vertically spaced superimposed crown shafts 58 which have internal threads adapted to mate with the threads on shafts 57. Mounted upon the crown shafts 58 are sprockets 59 upon which a chain 60 is looped so that rotation of crown shaft 58 causes synchronous rotation of the other vertically spaced apart crown shaft. In this manner, the advancement of the side rams 7 and 8 will be uniform even though each ram has two shafts 57 which are used to propel the ram.

In order to synchronize the advancement of each side ram 7 and 8 such that a uniform pressure is placed upon the baled stock, a means must exist to synchronize the advancement and the retraction of each ram. Accordingly, beam 48 carries an axle 61 which can be mounted either atop the beam or mounted through the beam 48 if it is hollow as illustrated in FIG. 10. The axle 61 does not project beyond the outermost side wall of the hollow upright support members 47. Positioned around axle 61 is a sprocket 62 which is mounted within the hollow upright support member 47. The upper crown shaft 58 also has a corresponding sprocket 62(*a*) which is placed adjacent the sprocket 59. Thus, the upper crown shaft 58 has two side-by-side sprockets, one of which is in alignment with the lower sprocket 59, around the lower crown shaft 58, while the other is in alignment with the sprocket 62, on axle 61. Rotation of the upper crown shaft 58 is synchronized with the axle 61 by means of a chain 63 which loops around both of the sprockets 62 and 62(*a*). Because both side rams 7 and 8 are driven by the chain drive in the manner just described, rotation of axle 61 causes both shafts 57 to advance synchronously their respective rams, so that the rams themselves are synchronously advanced and retracted in order to assure a constant pressure being placed upon the baled stock to produce a uniform density bale. Axle 61 is driven by a separate prime mover 64, such as an electric motor, hydraulic motor, pneumatic motor, or the like.

If a hydraulic circuit with hydraulic cylinders is employed to advance and retract the side rams 7 and 8, as illustrated in FIG. 11, hydraulic cylinders 65 are mounted adjacent hollow upright support member 47. The hydraulic cylinders 65 are in fluid communication with a control mechanism 66, which ensures that each cylinder 65 is under uniform hydraulic pressure and assures that the cylinder 65 advances each side ram 7 and 8 an equal distance. The control mechanism 66 is also fluidly connected to the pump 28. Optionally, hydraulic cylinders 65 may have their own hydraulic fluid pump. However, because the end wall platen 5 and the side rams 7 and 8 are never moved under a heavy load at the same time, a single hydraulic fluid pump could be adequate to power all the hydraulic cylinders necessary to operate the baler 1.

Figure 6:
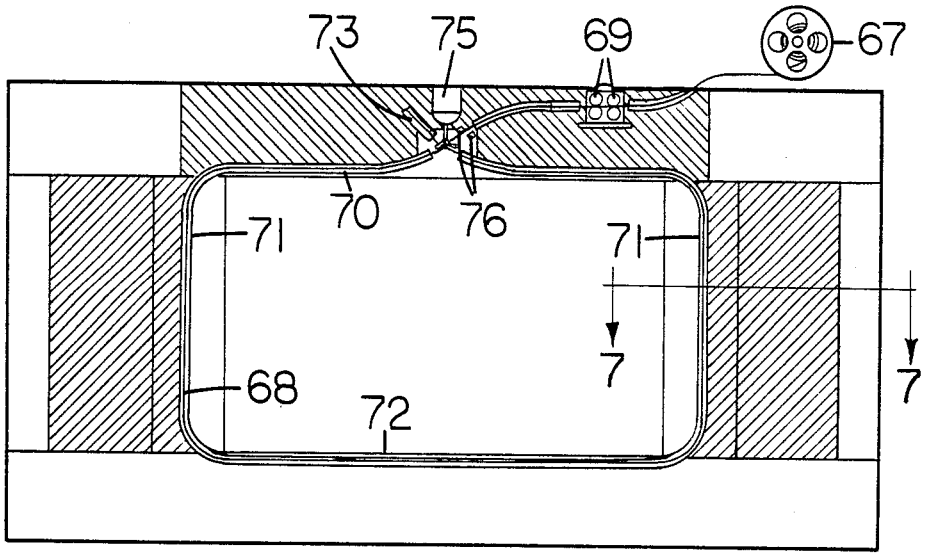
FIG. 6 illustrates one of the automatic wire feed traverses of the present invention.
Figure 7:
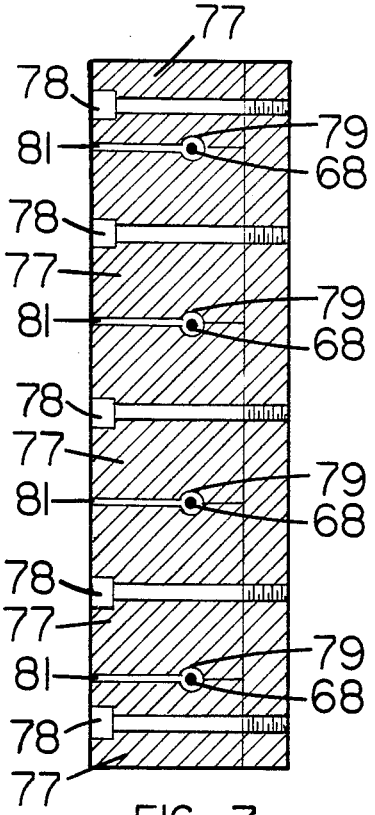
FIG. 7 is a cross-sectional plan view of one of the side rams as viewed along line 7—7 illustrated in FIG. 6.
Figure 8:
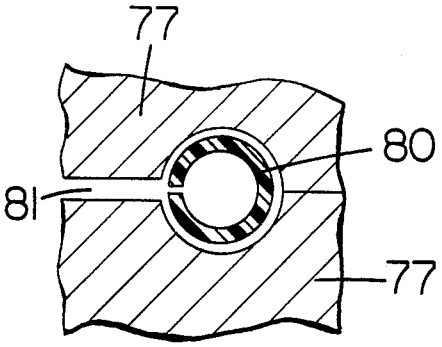
FIG. 8 is an enlarged cross-sectional view of the wire traverse.

FIGS. 6, 7 and 8 illustrate a typical wire tying apparatus. Typically, a source of wire 67 generally wound upon a spool, is positioned adjacent the baler 1 near the end wall 6. Optionally, the source of wire 67 could be mounted upon beam 48 in a manner well known to those skilled in the art. Whenever the baler is in its completely closed position, that is the position where the end wall platen 5 mates with end wall 6, and the side rams 7 and 8 are fully projected into the interior of the baler, the raceway 70 in the flat upper portion 29 of the door 32 is flush with the raceway 71 in the side rams 7 and 8 and with the raceway 72 in the flat lower portion 10 of end wall platen 5. With raceways 70, 71 and 72 in alignment, the rotational wheels 69 feed the wire 68 from the source of wire 67 around raceways 70, 71 and 72 until the wire reaches the raceway stop 73, which includes means to automatically disengage the rotating wheels 69 and simulataneously activate the tying device 75, which ties the looped wire into a knot and then activates a cutter 76 which cuts the wire wound around the baled stock from the source of wire.

The raceways 70, 71 and 72 are all formed in a manner illustrated in FIG. 7 in which a plurality of wires are simulataneously wound around each bale to securely bind it. Each wire has its own source of wire, wire raceways, tying device and cutter. As illustrated in FIG. 7, a plurality of blocks 77 are spaced apart from one another approximately the distance of the diameter of the wire 68, Each block 77 contains a semi-spherical groove 79, which when mated with other blocks 77 form the raceways 70, 71 and 72. The blocks 77 are mounted upon the door 32, end wall platen 5 and side rams 7 and 8 by hex head bolts 78 which mount flush with the compression surface of each of the door, the end wall platen and side rams 7 and 8. Accordingly, when the raceways wear out or are in need of maintenance, they can easily be removed by removing the hex head bolts 78 and the associated blocks 77.

As illustrated in FIG. 8, each raceway 70, 71 and 72 includes a tubular plastic liner 80 with a slit therein which is in alignment with the slot 81 formed by spacing the blocks 77 from one another. The flexible plastic liner 80 is designed to retain the wire 68 in the raceways 70, 71 and 72 until after the tying device 77 has completed its function and the cutter 76 has cut the wire. When the side rams 7 and 8, and end wall platen 5 are retracted, the wire 68 is pulled through the slit in the plastic liner 80 and through the slot 81. The spring back of the stock in the bale tightens the wires.

Figure 12:
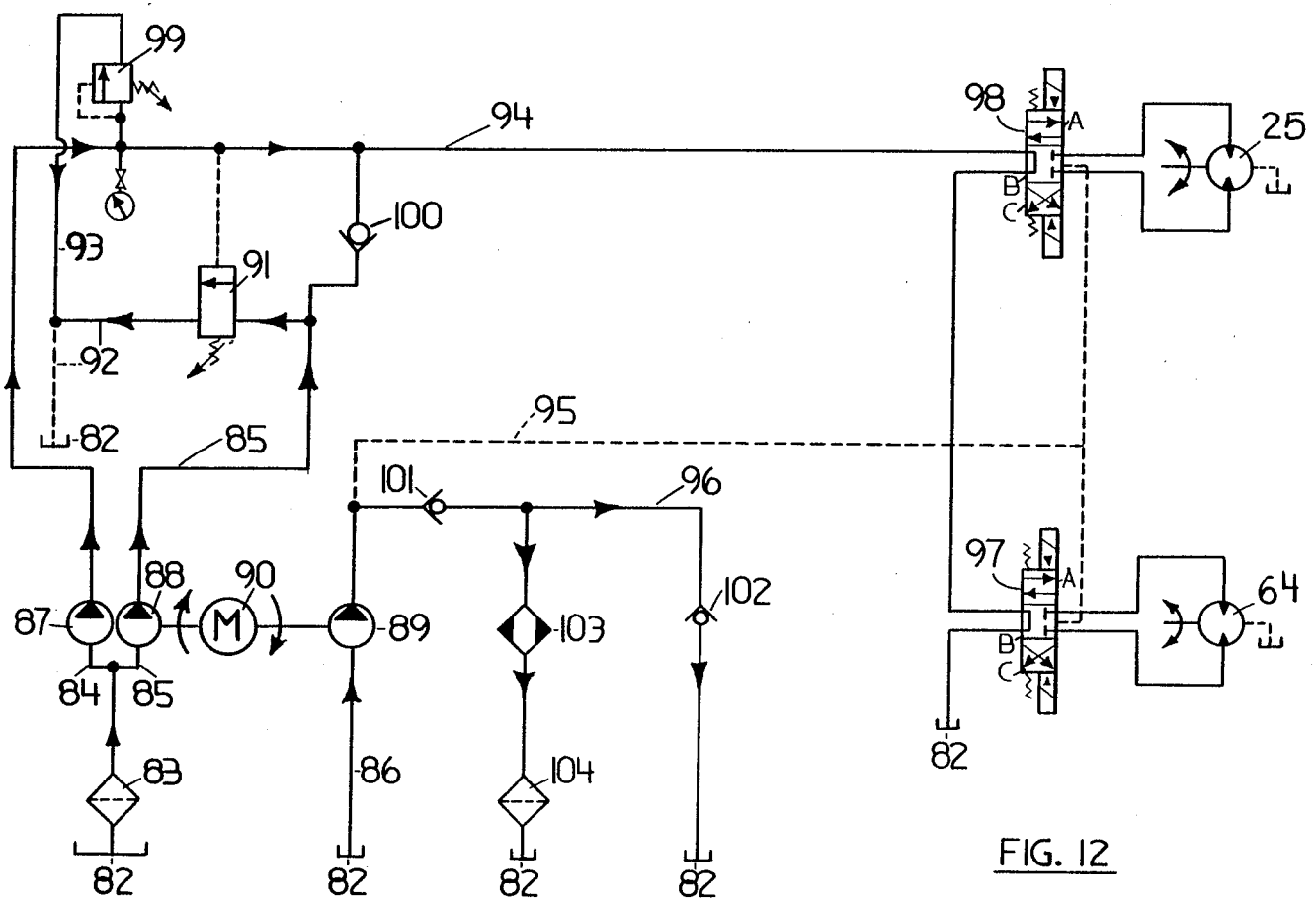
FIG. 12 illustrates a hydraulic fluid circuit for operating the present invention.

The hydraulic circuit illustrated in FIG. 12 may be employed to drive the chain drive system illustrated in FIGS. 3, 9 and 10. A storage tank 82 illustrated in several locations in FIG. 12 for simplification purposes only, is fluidly connected to a micron filter 83 which eliminates any dirt particles or small metal filings that may find their way into the hydraulic circuit system. From filter 83 the hydraulic circuit splits into two flow paths 84 and 85. Flow path 84 is directly coupled to a low volume, high pressure pump 87, while flow path 85 is directly coupled to a high volume, low pressure pump 88. Additionally, flow path 86 leads directly from the tank 82 to a third pump 89, which is also low pressure. A motor 90 is designed to run all three pumps 87, 88 and 89, which is easily accomplished with a relatively low horsepower motor, because only one of the three pumps is fully activated at any one time. By fully activated it is meant that the pumps are operating at their maximum capacity which would require the great majority of the power of motor 90. However, it is posible that the motor 90 will be operating all three pumps in the initial phases of the hydraulic circuit cycle when the loads on all pumps are still minor.

From high volume pump 88 flow path 85 is directly coupled to a pressure unloading valve 91 which may be, for example, set at approximately 350 psi. The pressure unloading valve 91 is designed to dump the hydraulic fluid from the high volume pump 88, which is flowing through flow path 85, back into tank 82 whenever this preset pressure is exceeded. This is accomplished by line 92 which is connected from the outlet side of the pressure unloading valve 91 to tank 82. If the pressure in flow path 85 is less than 350 psi, for example, the hydraulic fluid will proceed to check valve 100 which sets the miminum hydraulic fluid pressure at, for example, 5 psi. Accordingly, in order for the fluid in flow path 85 to flow freely in a working manner, the fluid pressure in flow path 85 must exceed 5 psi, but must not exceed 350 psi, for example.

Flow path 84 continues from low volume pump 87 to cartridge relief valve 99 which can be, for example, set at approximately 2250 psi. If the pressure in flow path 84 exceeds the set pressure, the cartridge relief valve 99 dumps the hydraulic fluid to tank 82 via line 93. Both flow paths 84 and 85 are combined to form flow path 94. Serially arranged in flow path 94 are two directional valves 98 and 97 which supply hydraulic fluid to hydraulic motors 25 or 64, respectively. Depending upon the position of directional valve 98 and 97, hydraulic motors 25 or 64 will be either advancing the end wall platen 5 or side wall rams 7 and 8, or retracting the end wall platen 5 and side wall rams 7 and 8. For example, if valve 98 is in position A, the end wall platen 5 is driven toward end wall 6. At this time, directional valve 97 will be in the B position such that the hydraulic fluid is returned to tank 82, i.e., the side rams 7 and 8 are inactivated. If the directional valve 98 is in the C position, the end wall platen 5 is retracted to its original position, while the hydraulic fluid again flows to tank 82 because directional valve 97 is again in the B position.

On the other hand, when directional valve 97 is in the A or C position, causing extension or retraction, respectively, of side rams 7 and 8, valve 98 will be in the B position.

Flow path 86 and low volume pump 89 are employed to position the directional valves 98 and 97 through flow path 95. In order to shift either valve 98 or 97, the pressure in flow path 95 must not exceed 65 psi, for example. This is accomplished by the incorporation of check valve 101 which will open when the hydraulic fluid pressure exceeds, for example, 65 psi and pass the hydraulic fluid through a heat exchanger 103 and a filter 104 to tank 82. In the event that the filter or heat exchanger becomes clogged, a safety line 96 with a check valve 102, having the same preset value as check valve 101, is designed to bypass the filter 104 and heat exchangers 103, respectively, and return the fluid directly to the tank 82.

The operation of the baler of the present invention will now be described wth respect to the chain drive system employing hydraulic motors. When sufficient stock is placed in baler 1, motor 90 is engaged and the high volume pump 88 pressurizes flow path 85 and 94, while simultaneously engaging low volume pump 89 which develops sufficient hydraulic fluid pressure in flow path 95 to shift valve 98 to the A position while valve 97 remains in the B position. This positively engages hydraulic motor 25 which advances the end wall platen 5 toward its mating end wall 6 by rotating shaft 24 and correspondingly chains 18 and 21. As the end wall platen 5 starts to compact the stock, the hydraulic pressure in line 85 and 94 becomes significantly higher. When the pressure within line 85, for example, attains a preset value such as 350 psi, pressure unloading valve 91 is activated which dumps the hydraulic fluid in line 85 back into the tank 82 through line 92. Accordingly, motor 90 now primarily operates low volume pump 87, although pumps 88 and 89 are still activated. High pressure, low volume pump 87 develops pressure slowly and thus end wall platen 5 advances more slowly, but it is now capable of developing the higher pressure necessary to attain a uniform density bale. When end wall platen 5 mates with end wall 6, electrical controls shift the pressure in line 95 to disengage valve 98 from the A position to the B position and energizes valve 97 from the B position to the A position. This causes end wall platen 5 to remain stationary while hydraulic motor 64 is engaged to rotate shaft 61 and correspondingly chains 60 and 63. Thus, the side rams 7 and 8 further densify the stock. When the side rams 7 and 8 have fully extended themselves, valve 98 will remain in the B position and valve 97 will now be shifted from the A position to the neutral B position while the baled stock is bound with the wire 68 as previously disclosed. Once the baled stock has been properly bound, valve 97 is shifted from the neutral B position to the reversing C position, while valve 98 remains in the B position. In this manner, the side rams 7 and 8 are retracted. When the side rams 7 and 8 are fully retracted, valve 97 shifts from the C position to the B position and valve 98 shifts from the B position to the reversing C position, whcih now causes end wall platen 5 to retract. Once the end wall platen 5 has retracted partially, the door 32 may be unlatched and the baled and bound stock may be removed through door 32. When the platen 5 and side rams 7 and 8 are fully retracted, the process may be repeated.

The operation of the hydraulic cylinder system is as follows: when the end wall platen 5 and side rams 7 or 8 are in their fully retracted position, the stock baler 1 is loaded with stock, such as paper. The amount of stock loaded into the baler 1 depends upon the type and grade of stock to be baled. Typically, the baler is mounted upon load cells one of which is schematically represented by reference numeral 105 in FIG. 9, which will indicate the amount of stock loaded therein. By means of the load cells, the proper amount of stock may be baled each and every time to provide a uniform density bale. Once the correct amount of stock has been loaded into the baler, the hydraulic pump 28 is energized to pump hydraulic fluid to cylinders 26 or 26*a*, which drives the end wall platen 5 toward the mating end wall 6. When end wall 5 and 6 are in the mating position, hydraulic fluid is no longer supplied to cylinders 26 or 26*a*, however, these cylinders maintain the mating relationship of end walls 5 and 6. Then, hydraulic pump 28 pumps hydraulic fluid to hydraulic cylinders 65, which drives side rams 7 and 8 toward one another until the correct density of the bale stock is attained. When the correct density is attained, wire 68 is fed from the source of wire around wire raceways 70, 71 and 72 until the wire reaches race stop 73. At this point the wire is tied in a typical fashion by tying device 75 and cutter 76 cuts the wire from source of wire 67. Side rams 7 and 8 are now retracted. As soon as the side rams have retracted, platen 5 is slightly retracted from its mating end wall 6. With the baled stock now being under no loading force from side rams 7 or 8 or end wall platen 5, latch 37 may be unlatched so that door 32 may now be opened to permit the discharge of the baled stock. Once end wall platen 5 and side rams 7 or 8 have reached their fully retracted position, and door 32 has been closed and latched, the procedure may be repeated.

Modification of the present invention may be made without departing from the spirit of it.

What is claimed is:

1. A stock baler comprising: a container having a bottom surface; two side walls attached upright to said bottom surface; a stationary end wall attached upright to said bottom surface, said stationary end wall having an upwardly, inwardly inclined interior surface which contacts said stock in said baler; a movable end wall positioned upright on said bottom surface having means to advance and retract said movable end wall, said movable end wall having an upwardly, inwardly inclined interior surface which contacts said stock in said container; said inclined interior surface of said stationary end wall is positioned opposite said inclined interior surface of said movable end wall; and a pair of side rams positioned in said side walls adjacent said stationary end wall having means to advance and retract said rams, whereby stock placed into said container is compressed into a bale by moving said movable end wall toward said stationary end wall in a closed position and then moving said pair of side rams toward one another.

2. The baler of claim 1, wherein said upwardly inclined interior surface of said stationary end wall and said movable end wall form a rectangular tube when in the closed position.

3. The baler of claim 2, wherein said pair of side rams advance and retract within said rectangular tube.

4. The baler of claim 2, wherein the cross section of each of said stationary end wall and said movable end wall is V-shaped.

5. The baler of cliam 4, wherein siad V-shaped end walls are positioned so that their open ends face one another and their apexes are in the same horizontal plane.

6. The baler of claim 1, wherein said container is mounted on weight scales.

7. The baler of claim 1, wherein said stationary end wall includes a door.

8. The baler of claim 7, wherein said door pivots about an upper edge.

9. The baler of claim 1, further including means to bind said bale.

10. The baler of claim 9, wherein said means to bind said bale includes means to automatically feed a wire around said bale.

11. The baler of claim 10, wherein said means to automatically feed a wire around said bale includes raceways formed in said pair of side rams, said stationary end wall and said movable end wall.

12. The baler of claim 11, wherein said pair of side rams, said stationary end wall, and said movable end wall have surfaces which contact said bale of stock, said surfaces having slits therein which are directly connected to said raceways.

13. The baler of claim 12, wherein said raceways include plastic tubing.

14. The baler of claim 13, wherein said plastic tubing includes a longitudinal slit so as to connect said plastic tubing to said slit.

15. The baler of claim 1, wherein said movable end wall and said pair of side rams are powered by a chain drive mechanism.

16. The baler of claim 1, wherein said movable end wall and said pair of side rams are powered by a hydraulic cylinder system.

* * * * *